United States Patent [19]

Tsuchida

[11] Patent Number: 4,656,702

[45] Date of Patent: Apr. 14, 1987

[54] EXPANDER AND GUIDER ROLLER

[76] Inventor: Isamu Tsuchida, c/o U Engineering Co. Ltd. 3-13-21 Awaji, Higashiyodogawa-ku, Osaka-shi, Japan

[21] Appl. No.: 824,889

[22] Filed: Jan. 31, 1986

Related U.S. Application Data

[62] Division of Ser. No. 688,004, Dec. 31, 1984, abandoned.

[51] Int. Cl.[4] ..... D06C 3/06

[52] U.S. Cl. ..... 26/75; 26/99; 226/15

[58] Field of Search ..... 26/75, 99, 104; 226/15

[56] References Cited

U.S. PATENT DOCUMENTS

| | | | |
|---|---|---|---|
| 1,716,555 | 6/1929 | Kane | 26/99 |
| 1,738,700 | 12/1929 | Hadwin | 26/99 |
| 2,164,241 | 6/1939 | Hall, Jr. | 26/99 X |
| 2,562,949 | 8/1951 | Robertson | 26/104 |
| 3,392,431 | 7/1968 | Bisang | 26/99 |
| 3,731,357 | 5/1973 | Shirai | 26/104 |

FOREIGN PATENT DOCUMENTS

| | | | |
|---|---|---|---|
| 2062 | of 1881 | United Kingdom | 26/99 |
| 7944 | of 1909 | United Kingdom | 26/99 |
| 18196 | of 1914 | United Kingdom | 26/99 |
| 485783 | 5/1938 | United Kingdom | 26/104 |

*Primary Examiner*—Robert R. Mackey
*Attorney, Agent, or Firm*—Larson and Taylor

[57] ABSTRACT

An expander roller comprises a straight shaft, rotary disk groups having a plurality of rotary disks rotatably put on said shaft, and a stretchable and resilient cylindrical member closely fitted on said rotary disk groups.

The rotary disk groups are formed by left- and right-hand rotary disk groups of which respective rotary disks are inclined in the opposite directions from the center to the both ends of said shaft, the inclination angles of the respective rotary disks in each group being gradually increased in the direction from the center to each end of said shaft.

With the rotation of the rotary disks by the travelling force of a travelling article, the resilient cylindrical member is rotated as being expanded and contracted along its entire width in the opposite directions from the center to the both ends of said member. The travelling article is expanded with expansion of the resilient cylindrical member.

3 Claims, 11 Drawing Figures

EXPANDER AND GUIDER ROLLER

BACKGROUND OF THE INVENTION

This is a division of application Ser. No. 688,004, filed Dec. 31, 1984, now abandoned.

There is known an expander roller, for example as schematically shown in FIGS. 10A and 10B for expanding a sheet-like travelling article such as a web, film or paper which travels on this roller as contacted therewith at a certain angle. Such expander roller is made up of a curved roller having a resilient cylindrical member C, such as a rubber cylindrical member, put on a curved shaft A through a plurality of rotary disks B. A sheet-like travelling article E may be expanded under the action of the convex arcuate surface D.

According to such curved expander roller, the center portion of a sheet-like travelling article in close contact with the roller surface is subjected to a strong expanding force and therefore easily stretched. On the other hand, the selvedge portions of the travelling article come up and are easily separated from the roller surface. Accordingly, such selvedge portions are not only expanded insufficiently but also susceptible to creases. Since the travelling article is inevitably expanded at its center portion according to the convex arcuate shape of the roller, the travelling article wound on a take-up roller disadvantageously presents a swelled shape.

SUMMARY OF THE INVENTION

The present invention relates to improvements in a straight-type expander roller.

It is a main object of the present invention to provide an expander roller capable of uniformly expanding a sheet-like travelling article, such as a travelling web, film, paper, along the entire width thereof, thereby to prevent the travelling article from being creased at its selvedge portions.

It is another object of the present invention to provide an expander roller capable of adjusting the amount of expansion of a travelling article and providing different amounts of expansion at the left and right sides of the expander roller, by suitably rotating the shaft in its circumferential direction to change the arrangement condition of the rotary disks in the circumferential direction of the shaft.

The expander roller in accordance with the present invention comprises a journalled straight shaft, rotary disk groups having a plurality of rotary disks rotatably put on the shaft, and a stretchable and resilient cylindrical member closely fitted on the rotary disk groups, and is characterized in that the rotary disk groups are formed by a left-hand rotary disk groups and a right-hand rotary disk group of which respective rotary disks are inclined in the opposite directions from the center to the both ends of the shaft, the inclination angles of the respective disks of each group being gradually increased by a predetermined amount in the direction from the center to each end of the shaft.

According to the expander roller of the present invention, the respective rotary disks are inclinedly put on the shaft at gradually increased inclination angles in each direction from the center to each end of the shaft. Uniform expansion along the entire width of a sheet-like travelling article is therefore achieved with the selvedge portions of the travelling article not creased, thus greatly improving the state of the travelling article as taken up by a take-up roller.

According to the present invention, the expander roller is arranged such that the amount of expansion is changed in the circumferential direction of the roller. It is therefore posssible to adjust the amount of expansion on the surface of the roller with which a travelling article comes in contact, by suitably rotating the shaft in its circumferential direction to change the arrangement condition of the rotary disks in the circumferential direction of the roller.

According to the expander roller of the present invention, the left- and right-hand rotary disk groups may be put on the shaft in a symmetrical manner, or may be displaced inclination angle by about 90° in the circumferential direction of the shaft. It is therefore possible to provide various modes of expansion, such as equal expansion or unequal expansion at the left and right sides of the roller, or expansion only at the left or right side of the roller.

DETAILED DESCRIPTION OF PREFERRED EMBODIMENTS

According to a first embodiment of the present invention shown in FIGS. 1 to 4, an expander roller comprises a straight shaft, rotary disk groups having a plurality of rotary disks rotatably put on the shaft, and a stretchable and reilient cylindrical member closely fitted on the rotary disk groups.

The straight shaft 1 is journalled normally in an unrotatable manner, but, as necessary, may be rotated in its circumferential direction by, for example a worm gear 2 to be operated by a handle wheel 3.

Figure 1:
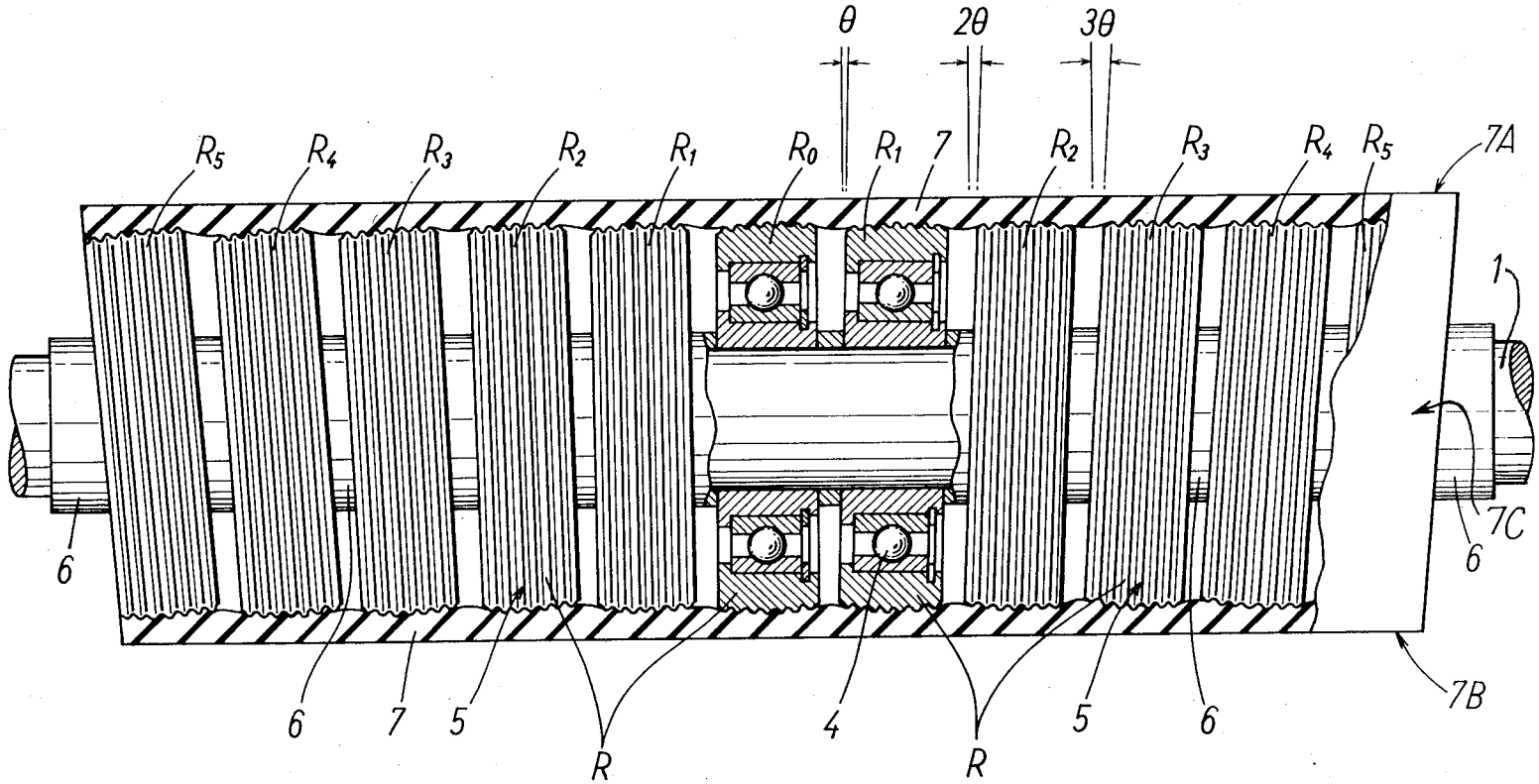
FIG. 1 is a partial section view in front elevation of an expander roller in accordance with a first embodiment of the present invention.

The rotary disk groups include a plurality of rotary disks R rotatably put on the shaft 1 through bearings 4, each disk having a plurality of antiskid grooves 5 on the peripheral surface. In this embodiment, one rotary disk $R_0$ is put on the shaft 1 at its center at right angle to the axis thereof. Two groups of the rotary disks $R_1$–$R_5$ are symmetrically and inclinedly put on the shaft 1 in the opposite directions from the center rotary disk $R_0$ to the both shaft ends at regular intervals with the use of fixing spacers 6. The inclination angles of the disks $R_1$–$R_5$ of each group are gradually increased by a predetermined angle, for example $\theta°$, in the direction fom the center to each end of the shaft, as shown in FIG. 1.

The resilient cylindrical member 7 may be made of a rubber cylindrical member having suitable stretch properties, and normally has a circle section having a perfect roundness. This cylindrical member 7 is closely fitted on the rotary disks with the both ends of the cylindrical member 7 being in accord with the outermost ends of the left- and right-end rotary disks $R_5$. As shown in FIG. 1, the cylindrical member 7 is closely fitted on the rotary disks with its upper portion 7A most stretched in the roller axial direction, its lower portion 7B most contracted in the roller axial direction and its intermediate portion 7C neither stretched nor contracted. There is thus formed an expander roller having a trapezoid section in front elevation having a long upper side and a short lower side.

Figure 2:
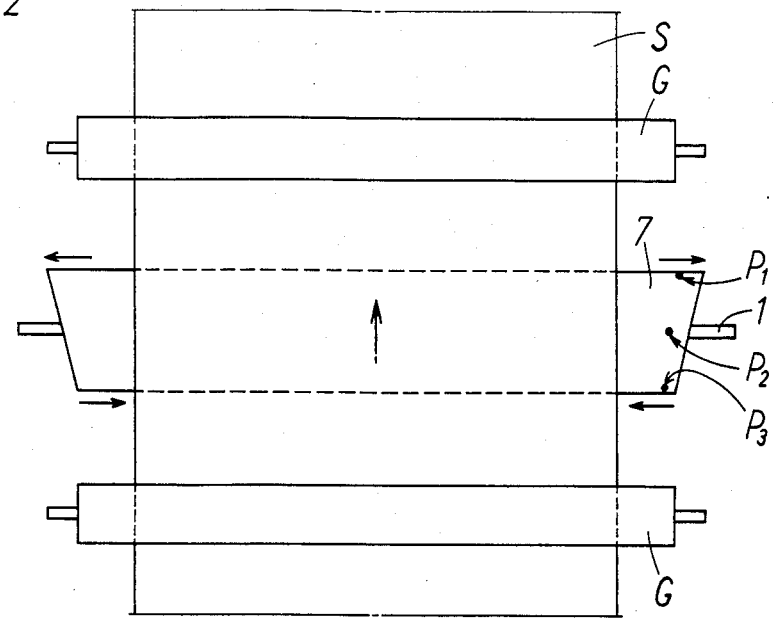
FIG. 2 is a front view of the first embodiment, illustrating how to use the expander roller in FIG. 1.
Figure 3:
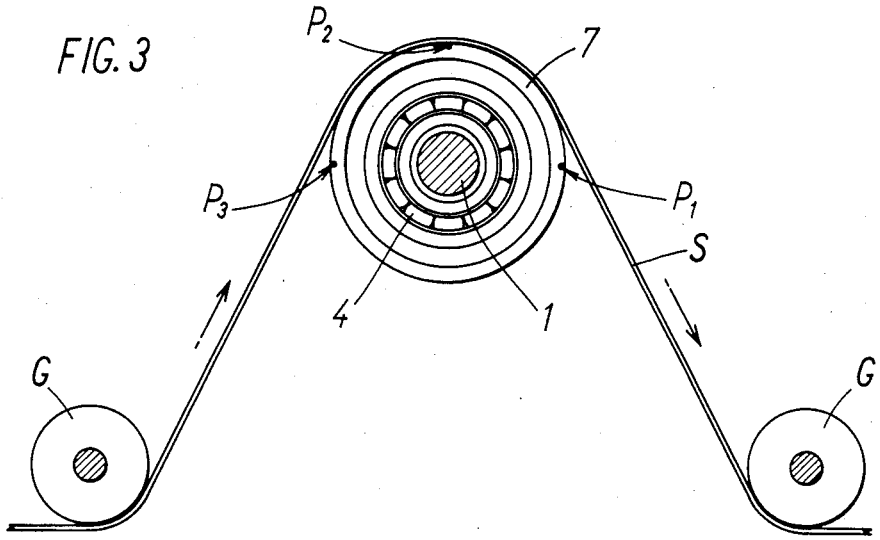
FIG. 3 is an enlarged side view of FIG. 2.

The shaft 1 of the expander roller formed as discussed hereinbefore is secured to a machine frame ( not shown). For example as shown in FIGS. 2 and 3, through guide rollers G, a sheet-like travelling article S is travelled on the roller surface as contacted therewith at a certain angle with Point P1 where the resilient cylindrical member 7 is most stretched, being located at the travelling article delivery side. The expander roller is rotated together with the rotary disks by the travelling force of the travelling article S. The resilient cylindrical member 7 is rotated, while its entire surface is uniformly and symmetrically stretched and contracted by rotation of the rotary disks R in the opposite directions from the center to the both ends of the cylindrical member 7.

The travelling article S travelling on the expander roller as contacted therewith from Point P3 where the resilient cylindrical member 7 is most contracted, is therefore subjected to an incremental expanding action during the interval when the travelling article S passes through Point P3 to Point P1 via Point P2. When the travelling article S passes through Point P1, it is subjected to the maximum expanding action. Since the travelling article S comes, at its entire width, in contact with the roller surface, the expander roller effects uniform expansion along its entire length in the opposite directions from the center to the both ends of the roller. The travelling article S is therefore subjected to a uniform expanding action along its entire width.

Figure 4:
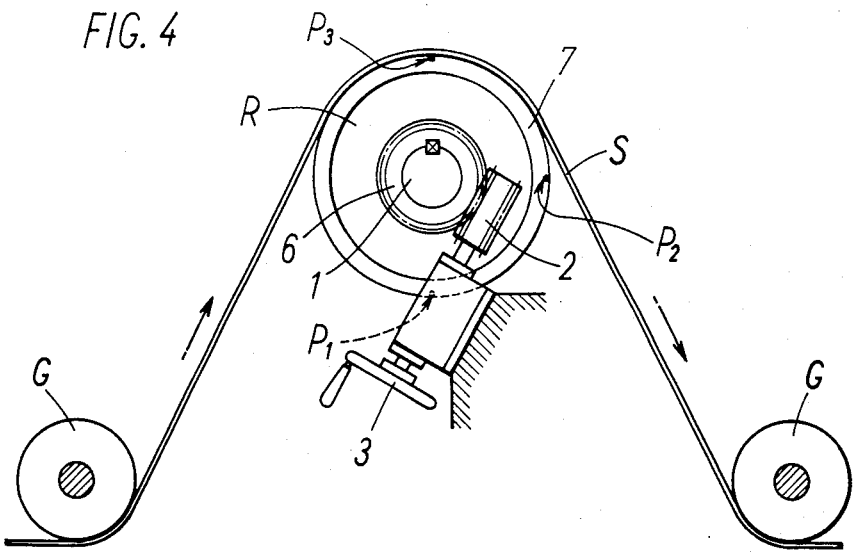
FIG. 4 is a view illustrating how to adjust the expanding action.

As schematically shown in FIG. 4, with the use of a worm gear 2 or the like to be operated by a handle wheel 3, the shaft 1 may be rotated. For example, shaft 1 can be rotated 90° so that Point P1 where the reilient cylindricl member 7 is most stretched is located vertically below Point P3 and far removed from contact with the travelling article S. In this position, a relative great reduction is achieved in the expanding action of the roller. Thus, the expanding action of the roller may be suitably adjusted by suitably rotating the shaft 1.

FIGS. 5 to 9 illustrate a second embodiment of the present invention.

Likewise the first embodiment, tow left- and right-hand rotary disk groups, respectively, include a plurality of rotary disks inclinedly and rotatably put on the shaft 1 in the opposite directions from the cneter to the both ends of the shaft, the inclination angles of the disks in each group being gradually increased by a predetermined angle, for example $\theta°$, in the direction from the center to each end of the shaft.

Figure 5:
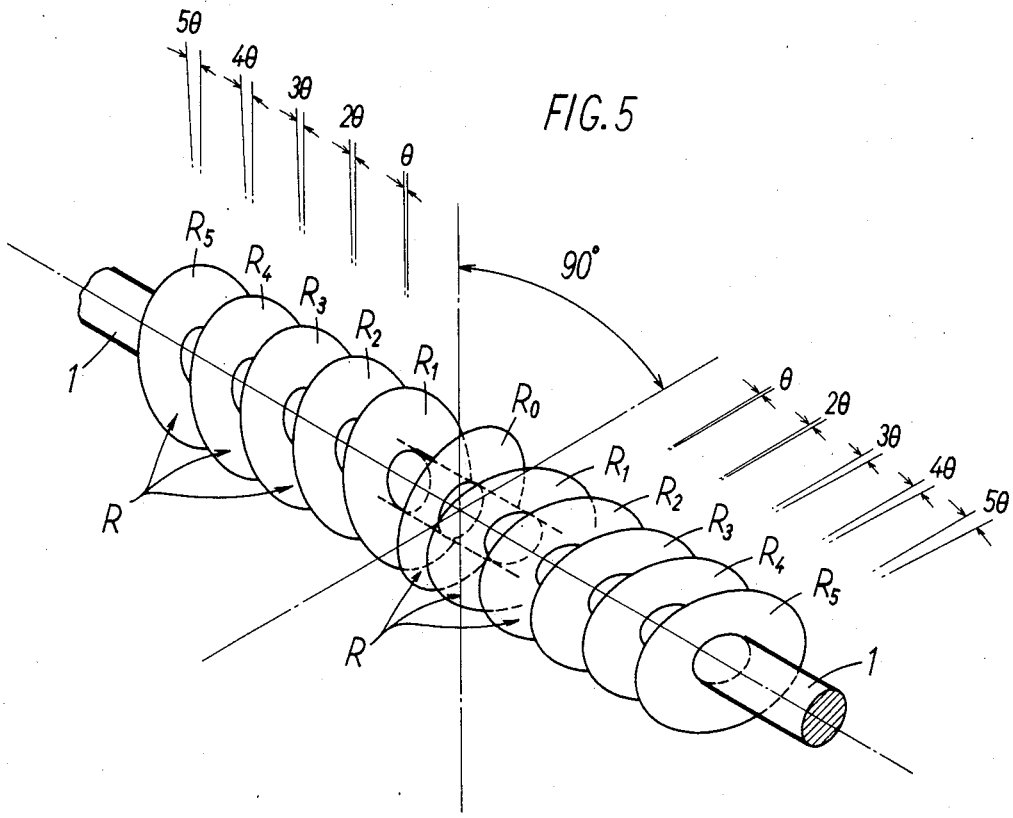
FIG. 5 is a simplified perspective view of an expander roller in accordance with a second embodiment of the present invention, illustrating how left- and right-hand rotary disk groups are put on a shaft.

In the second embodiment, however, the rotary disks of the left-hand rotary disk group are displaced in inclination angle about about 90° in the shaft circumferential direction with respect to those of the right-hand rotary disk group, as shown in FIG. 5. Except for such arrangement, the second embodiment is substantially same in construction as the first embodiment. In FIGS. 5–9, like parts are therefore designated by like numberals used in FIGS. 1–4.

Disposed at the end of the shaft 1 is a gear 8, with which a gear 10 to be rotated by a reversible motor 9 is meshed. The motor 9 may be rotated either forwardly or reversely upon the reception of a signal 12 from a selveldge detector 11 adjacent the selvedge of a sheet-like travelling article S. The motor 9 is designed not be rotated during the interval when signal 12 is not transmitted thereto.

The basic principle of expanding action of the expanding roller according to the second embodiment is the same as that in the first embodiment. However, in the second embodiment, the left-hand rotary disk group is displaced in the circumferential direction of the shaft by about 90° with respect to the right-hand rotary disk group. The second embodiment is therefore slightly different in the expanding action from the first embodiment. The description will then be made of how a travelling article is expanded in the second embodiment.

Figure 6:
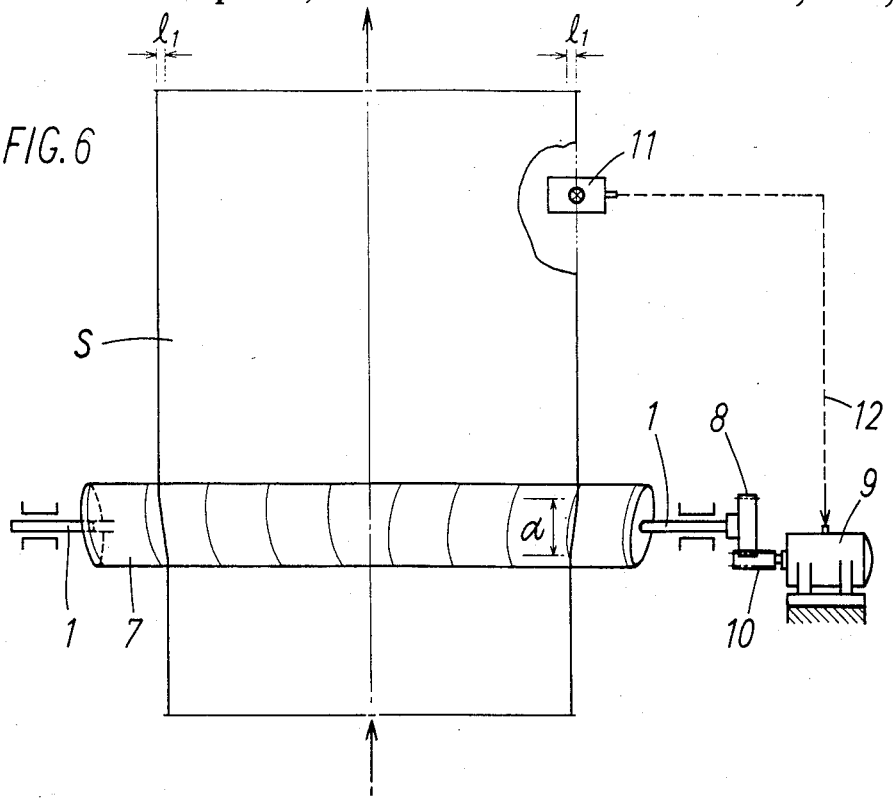
FIG. 6 is a front view of the second embodiment, illustrating how to use the expander roller in accordance with the second embodiment.
Figure 7:
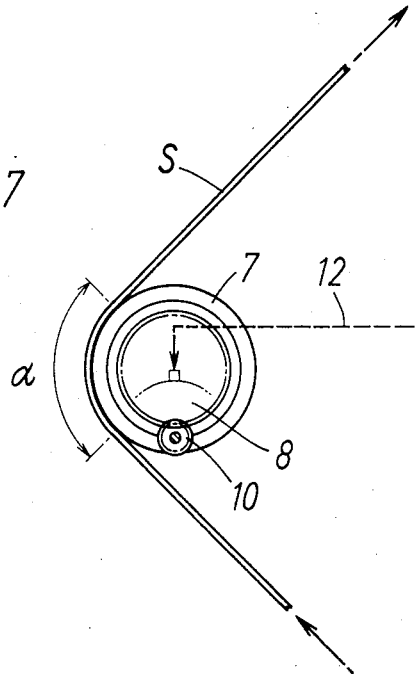
FIG. 7 is an enlarged side view of main portions of FIG. 6.

FIGS. 6 and 7 illustrate a sheet-llike travelling article S as properly expanded.

The expander roller is located at a neutral position where the travelling article S travelling on the resilient cylindrical member 7 as contacted with the surface thereof, is expanded equally in the opposite directions from the center to the both ends of the shaft. At this time, the travelling article S comes in contact with the surface of the resilient cylindrical member 7 in the angular contact area $\alpha$. The resilient cylindrical member 7 is to be rotated with the tavelling article S. When the travelling article S passes through this angular contact area $\alpha$, the travelling article S is expanded at its both ends by an amount of expansion l1 (FIG. 6). At this time, the travelling article subjected to expansion travels at the normal position and, therefore, the selvedge detector 11 detects no displacement of selvedge. With the motor 9 not rotated, the shaft 1 is held at the position as it is and a proper expansion is continuously made of the travelling article.

Figure 8:
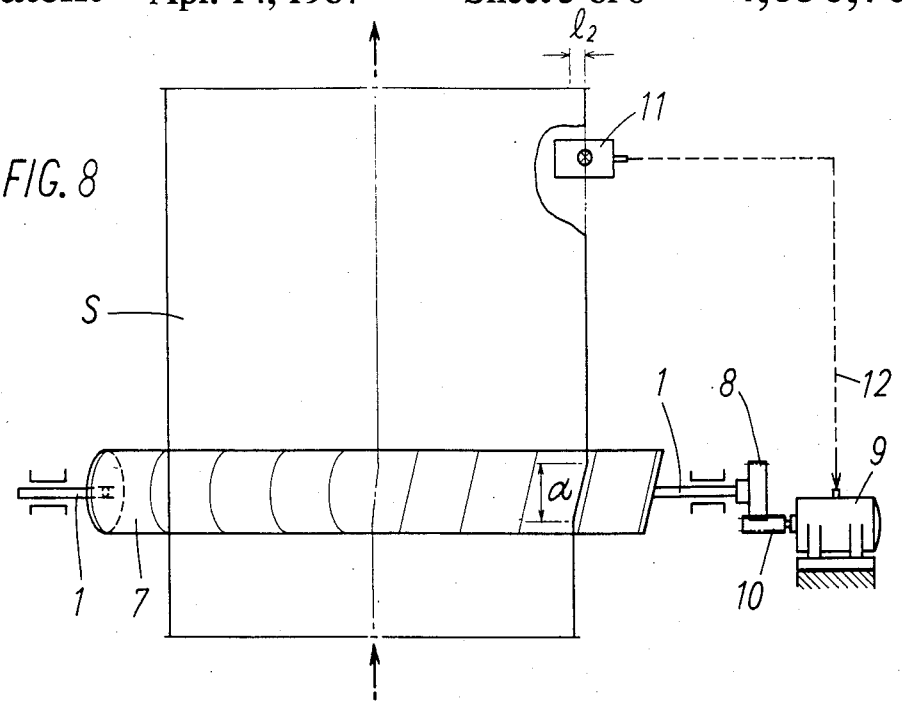
FIGS. 8 and 9 are front views, illustrating how to adjust the expanding action.

For example, when the travelling article S is displaced to the left side with respect to the normal travelling direction, the selvedge detector 11 detects such displacement to transmit a signal 12, by which the motor 9 is rotated, for example, in the reverse direction with respect to the rotation direction of the expander roller. Through the gears 8 and 10, the shaft 1 is then rotated in the reverse direction to the article travelling direction by a predetermined angle (about 45° from the position shown in FIGS. 6 and 7). The left- and right-hand rotary disk groups are changed in arrangement, so that the resilient cylindrical member 7 is arranged as shown in FIG. 8. Then, the left-hand surface of the resilient cylindrical member 7 in the contact are $\alpha$ is rotated substantially in a parallel direction to the travelling direction of the travelling article S, while the right-hand surface is rotated in a direction inclined to the right side with respect to the travelling direction of the travelling article.

The left side of the travelling article S is guided in a normal direction parallel with the travelling direction, while the right side of the travelling article S is expanded by an amount of expansion 12 dependent on the inclination angles of the rotary disks.

Figure 9:
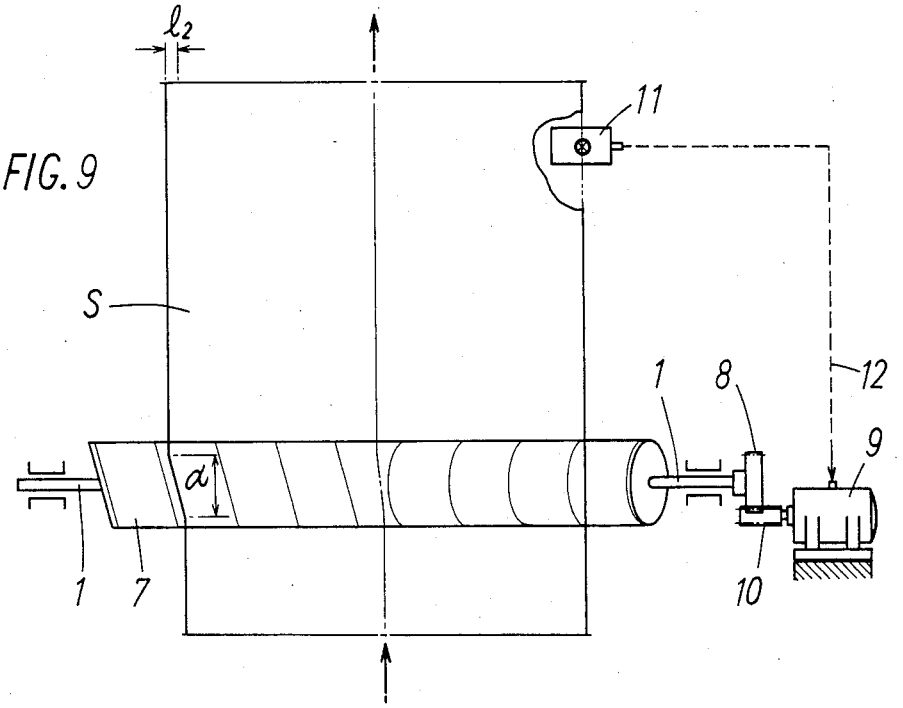
Figure 10A:
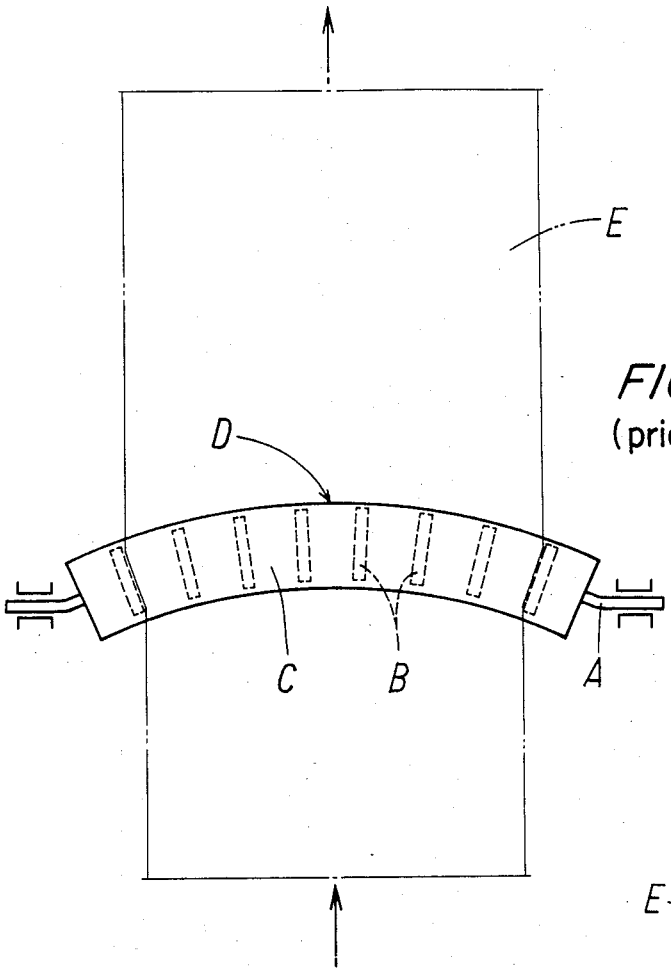
FIG. 10A (prior art)
FIGS. 10A and 10B are, respectively, front and side veiws of a conventional curved expander roller put in use.
Figure 10B:
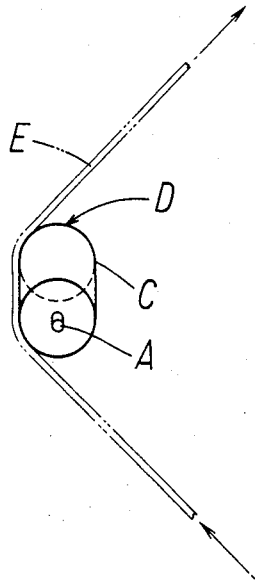
FIG. 10B (prior art)

If the travelling article S is excessively expanded in the right direction by such correction of displacement, or if the travelling article S is originally displaced in the right side with respect to the normal travellin direction, the travelling article S is subjected to expansion in the reverse direction. That is, upon the reception of a signal 12 from the selvedge detector 11 which has detected displacement, the motor 9 is rotated in the same direction as the rotation direction of the expander roller. Through the gears 8 and 10, the shaft 1 is rotated in the same direction as the normal travelling direction by a predetermined angle (about 45° from the position shown in FIGS. 6 and 7). The left- and right-hand rotary disk groups are changed in arrangement. The resilient cylindrical member 7 of the expander roller is then arranged as shown in FIG. 9. Then, the right-hand surface of the resilient cylindrical member 7 in the contact area $\alpha$ is rotated substantially in a direction parallel with the normal travelling direction of the travelling article S, while the left-hand surface of the resilient cylindrical member 7 is rotated in a direction inclined to the left side with respect to the travelling direction of the travelling article S. With such arrangement, the right side of the travelling article S is normally guided in parallel with the travelling direction, while the left side of the travelling article S is expanded by an amount of expansion 12 dependent on the inclination angles of the rotary disks.

It is to be noted that means for rotating the shaft 1 may be of the type manual, electrical or mechanical.

The present invention has been thus described, but it is not limited to the embodiments discussed and illustrated just by way of example, and various modifications may be made without departing from the spirit and scope of the present invention.

What I claim is:

1. An expander and guider apparatus for expanding and guiding a sheet-like travelling article comprising:

an expander roller which engages the article comprising (a) a straight shaft, (b) rotary disk groups each having a plurality of rotary disks rotatably put on said shaft, and (c) a stretchable and resilient cylindrical member closely fitted on said rotary disk groups, said rotary disk groups being formed by a left-hand rotary disk group and a right-hand rotary disk group of which respective rotary disks are inclined in the opposite directions from the longitudinal center of said shaft to the both ends thereof, the inclination angles of said rotary disks in each of said rotary disk groups being gradually increased by a predetermined amount in the direction from the center to each end of said shaft, said expander roller being characterized in that the left-hand rotary disk group is displaced in the circumferential direction of the shaft by about 90° with respect to the right-hand rotary disk group such that the relative expanding action of each said rotary disk groups on the article is non-symmetrical with respect to the other said rotary disk group except where the article contacts the expander roller at a unique neutral position where the relative expanding action of each said rotary disk group on the article is symmetrical;

a selvedge detector located downstream of said expander roller for detecting the position of a travelling edge of the article and for producing a signal indicative of the deviation of the edge of the article on either side of a predetermined desired position; and a shaft rotating means for selectively displacing said shaft in the circumferential direction in response to signals from said selvedge detector of a deviation of the edge of the article from the desired position such that when the travelling article upsteam of said expanding roller is laterally shifted as sensed by said selvedge detector, the expanding action of said expander roller is adjusted whereby the travelling article is preferentially expanded on the opposite side from the direction of shift to compensate for the shift and to thereby produce an expanded article downstream of said expander roller which is not shifted.

2. An expander and guider apparatus as set forth in claim 1, wherein the 90° shifted left-hand rotary disk group and the right-hand rotary disk group are symmetrically inclined on the shaft with respect to the center of said shaft.

3. An expander and guider apparatus as set forth in claim 1, wherein each said rotary disk includes a plurality of circumferential antiskid grooves therearound to produce an undulating circumferential surface area such that said resilient cylindrical member contacts substantially the entire undulating surface area and is thus held thereby.

* * * * *